US005172843A

United States Patent [19]

Unuma

[11] Patent Number: 5,172,843

[45] Date of Patent: * Dec. 22, 1992

[54] STRUCTURES OF DRIVING AND DRIVEN SPROCKETS AND BELT RECEPTION ROTARY MEMBER IN PAPER FEED APPARATUS

[75] Inventor: Sadao Unuma, Aichi, Japan

[73] Assignee: Tokai Kogyo Kabushiki Kaisha, Oobu, Japan

[ * ] Notice: The portion of the term of this patent subsequent to Mar. 26, 2008 has been disclaimed.

[21] Appl. No.: 524,050

[22] Filed: May 16, 1990

[30] Foreign Application Priority Data

May 26, 1989 [JP] Japan ..... 1-134247

[51] Int. Cl.[5] ..... B65H 20/20

[52] U.S. Cl. ..... 226/74; 400/616.1; 226/170; 226/194; 474/197

[58] Field of Search ..... 226/74, 75, 170, 190, 226/194; 384/285, 296, 282, 284; 400/616.1, 616.2; 474/152, 197

[56] References Cited

U.S. PATENT DOCUMENTS

| | | | |
|---|---|---|---|
| 2,973,654 | 3/1961 | Ewing | 474/197 |
| 3,134,268 | 5/1964 | Firth | 474/197 |
| 3,270,577 | 9/1966 | Poundstone | 474/197 X |
| 3,953,689 | 4/1976 | Dainin | 384/296 X |
| 4,130,230 | 12/1978 | Seitz | 226/74 |
| 4,159,794 | 4/1979 | Seitz | 226/74 |
| 4,194,660 | 3/1980 | Seitz | 226/74 |
| 4,469,262 | 9/1984 | Seitz | 226/74 |
| 4,566,688 | 1/1986 | Seitz et al. | 226/74 |
| 4,568,320 | 2/1986 | Tangorra | 474/152 |
| 4,764,036 | 8/1988 | McPherson | 384/285 X |
| 4,789,088 | 12/1988 | Unuma et al. | 226/74 |
| 4,826,337 | 5/1989 | Unuma | 226/74 X |
| 5,002,413 | 3/1991 | Unuma | 400/616.2 |
| 5,026,328 | 6/1991 | Unuma | 226/74 X |
| 5,048,739 | 9/1991 | Unuma et al. | 226/74 |

FOREIGN PATENT DOCUMENTS

| | | | |
|---|---|---|---|
| 2655909 | 6/1978 | Fed. Rep. of Germany | 474/152 |
| 0094167 | 6/1982 | Japan | 474/152 |
| 0231065 | 9/1988 | Japan | 474/152 |

*Primary Examiner*—Daniel P. Stodola
*Assistant Examiner*—P. Bowen
*Attorney, Agent, or Firm*—Wenderoth, Lind & Ponack

[57] ABSTRACT

A paper feeding tractor in which perforated paper is fed by a pin carrying feed belt includes a feed belt driving sprocket which is housed between a pair of side frames. Two side faces of an inner circumferential portion of the sprocket body, except an outer circumferential portion formed with teeth, are formed with round fitting protuberances concentric with an axial hole therein such that the inner circumferential portion of the sprocket body is thinner than the outer circumferential portion. Thus, contact between the sprocket and the drive shaft is reduced to a relatively small sliding resistance. Paper can be moved in the axial direction of the drive shaft by a small force. During paper feed, any phase difference in rotation between the drive shaft and the sprocket can be eliminated. Alternatively, the feeding sprocket and a belt reception rotary member are housed within an auxiliary frame structure which is fit within and longitudinally slidable with respect to the main frame structure.

5 Claims, 8 Drawing Sheets

STRUCTURES OF DRIVING AND DRIVEN SPROCKETS AND BELT RECEPTION ROTARY MEMBER IN PAPER FEED APPARATUS

BACKGROUND OF THE INVENTION

1. Field of the Invention

This invention relates to the structures of driving and driven sprockets and belt reception rotary member in a paper feed apparatus that are supported rotatably between a pair of side frames for passing a feed belt around them.

2. Description of the Prior Art

Driving of a feed belt in a paper feed apparatus is by sprockets.

A feed belt is passed around a driving sprocket disposed between a pair of side frames disposed facing each other with a predetermined gap between them and supported at one of the end portions of these side frames, and a receiving member disposed at the other portion of the side frames, and this feed belt is driven by the rotation of the driving sprocket. There are cases where this receiving member is a belt receiver disposed integrally with the inner side surfaces of the pair of side frames, where it is a short cylindrical belt reception rotary member supported rotatably between the pair of side frames, and where it is a similar driven sprocket.

The structure of a known driving sprocket and the structure for supporting this driving sprocket in a pair of side frames are shown in FIGS. 17–20.

In this driving sprocket 51, engaging portions 53 project from both end surfaces of a sprocket main body 52 and these portions 53 are fitted into receiving holes 55 disposed in a pair of side frames 54*a*, 54*b* so that the driving sprocket 51 is supported rotatably by the pair of side frames 54*a*, 54*b*. A square shaft hole 56 is bored in the driving sprocket 51, a square driving shaft 57 is fitted into this shaft hole 56, and the driving sprocket 51 is rotated by the rotation of the driving shaft 57.

Quite naturally, the distance A' between the opposed surfaces of the driving shaft 57 is smaller than the distance B' between the opposed inner peripheral surfaces of the shaft hole 56 and in the state where the driving shaft 57 is inserted into the shaft hole 56, a predetermined clearance exists between them. Therefore, as shown in FIG. 19, the driving sprocket 51 can move a small amount with respect to the driving shaft 57 in its rotating direction and a phase difference $\theta$ occurs between the rotation of the driving shaft 57 and the driving sprocket 51 during the paper feed operation. This phase difference $\theta$ lowers paper feed accuracy and, eventually, the printing accuracy of a printer deteriorates. Then, as shown in FIGS. 19 and 20, when the driving shaft 57 is rotated in both forward and reverse directions to feed a sheet of paper in these directions, the phase difference described above becomes $2\theta$ so that the influences of the phase difference on the rotation of each of the driving sprockets 51 and the driving shaft 57 becomes larger.

This problem can be eliminated by minimizing the clearance between the shaft hole 56 of the driving sprocket 51 and the driving shaft 57. However, since the conventional driving sprocket 51 has a structure wherein the fitting portions 53 protrude from both end surfaces of the sprocket main body 52 as described above, the length L' of the shaft hole 56 becomes large and the thickness of the peripheral portion of the shaft hole 56 differs greatly in its longitudinal direction. In the case of a driving sprocket 51 consisting of a resin molded article, therefore, there is a problem that it is difficult from the aspect of molding to make the dimension of the shaft hole 56 uniform in the longitudinal direction. Accordingly, a design which makes it possible to smoothly insert the driving shaft 57 in the smallest portion of the shaft hole 56 must be employed so that the clearance between the shaft hole 56 and the driving shaft 57 becomes larger and this results in the reduction of paper feed accuracy.

As a paper feed apparatus which improves paper feed accuracy during the paper feed operation by preventing the fluctuation of the center distance between the driving sprocket supported at one of the end portions of the pair of side frames and the receiving member disposed at the other end portion, there is known a structure wherein auxiliary frames are fitted to the inner side surfaces of the pair of side frames in such a manner as to be capable of moving slightly in the travelling direction of the feed belt, the driving sprocket is supported rotatably by the auxiliary frames and the receiving member is provided on them. In the paper feed apparatus having such a structure, the thickness of the auxiliary frames cannot be made so great that the driving sprocket 51 having the structure wherein the fitting portions 53 protrude from both side surfaces of the sprocket main body 52 such as described above cannot be supported.

In such a paper feed apparatus equipped with the auxiliary frames, if the driven sprocket or belt reception rotary member has the same structure as that of the driving sprocket 51 when such a driving sprocket or belt reception rotary member is used as the receiving member for the feed belt, it cannot be supported by the auxiliary frames for the same reason as described above.

SUMMARY OF THE INVENTION

It is therefore a first object of the present invention to reduce the phase difference between the driving shaft and the driving sprocket during their rotation and to improve paper feed accuracy by improving dimensional accuracy of the shaft hole of the driving shaft and reducing as much as possible the clearance between the shaft hole of the driving sprocket and the driving shaft fitted into the shaft hole.

It is a second object of the present invention to make it possible to support rotatably driving and driven sprockets or a belt reception rotary member in a paper feed apparatus equipped with auxiliary frames while securing necessary support strength.

To this end, the paper feed apparatus of this invention includes a pair of side frames disposed facing each other with a predetermined gap between them, an endless feed belt disposed between the pair of side frames and a driving sprocket disposed between the pair of side frames and supported rotatably at one of their end portions, the feed belt being passed around the driving sprocket and a receiving member disposed at the other end portion of the pair of side frames and the feed belt being circulatingly run by the rotation of the driving sprocket to feed a sheet of paper, the apparatus of the present invention being characterized in that the thickness of the driving sprocket at least at the peripheral portion of the shaft hole is equal to, or smaller than, the width of the feed belt.

Accordingly, even when the driving sprocket consists of a resin molded article, the dimension of the shaft hole becomes uniform in the axial direction, its dimensional accuracy becomes higher and the clearance between the shaft hole and the driving shaft fitted into the shaft hole can be minimized. As a result, the phase difference between the driving sprocket and the driving shaft during their rotation becomes smaller and paper feed accuracy becomes higher.

Since the length of the shaft hole formed in the driving sprocket becomes smaller, the sliding resistance between the inner peripheral surface of the shaft hole of the driving sprocket and the outer peripheral surface of the driving shaft becomes smaller when the driving shaft is fitted into the shaft hole to move the paper feed apparatus along the driving shaft.

As a result, even when the clearance between the shaft hole of the driving sprocket and the driving shaft fitted into the shaft hole is made smaller, the overall paper feed apparatus can be moved by relatively small force along the driving shaft.

The present invention further provides round receiving recesses formed on both side surfaces of a driven sprocket or a belt reception rotary member so as to make the thickness of its inner peripheral portion smaller than the thickness of its outer peripheral portion, a rotation support portion is disposed inside both side surfaces of the driven sprocket or belt reception rotary member, fitting protruberances corresponding to the receiving recesses are disposed on the inner side surface of the pair of side frames and are fitted into the receiving recesses disposed on both side surfaces of the driven sprocket or the belt reception rotary member so as to support rotatably the driven sprocket or the belt reception rotary member between the pair of side frames.

Accordingly, even when the paper feed apparatus is equipped with the auxiliary frames, it is possible to form protruding fitting protuberances corresponding to the receiving recesses formed on the driven sprocket or the belt reception rotary member, on the side surfaces of the auxiliary frames, to fit them into the receiving recesses of the driven sprocket or the belt reception rotary member and to support rotatably the driven sprocket or the belt reception rotary member between the pair of auxiliary frames fitted onto the inner side surfaces of the pair of side frames to oppose each other, while securing necessary support strength.

These and other objects of the present invention will become more apparent from the following description.

DESCRIPTION OF THE PREFERRED EMBODIMENTS

Figure 1:
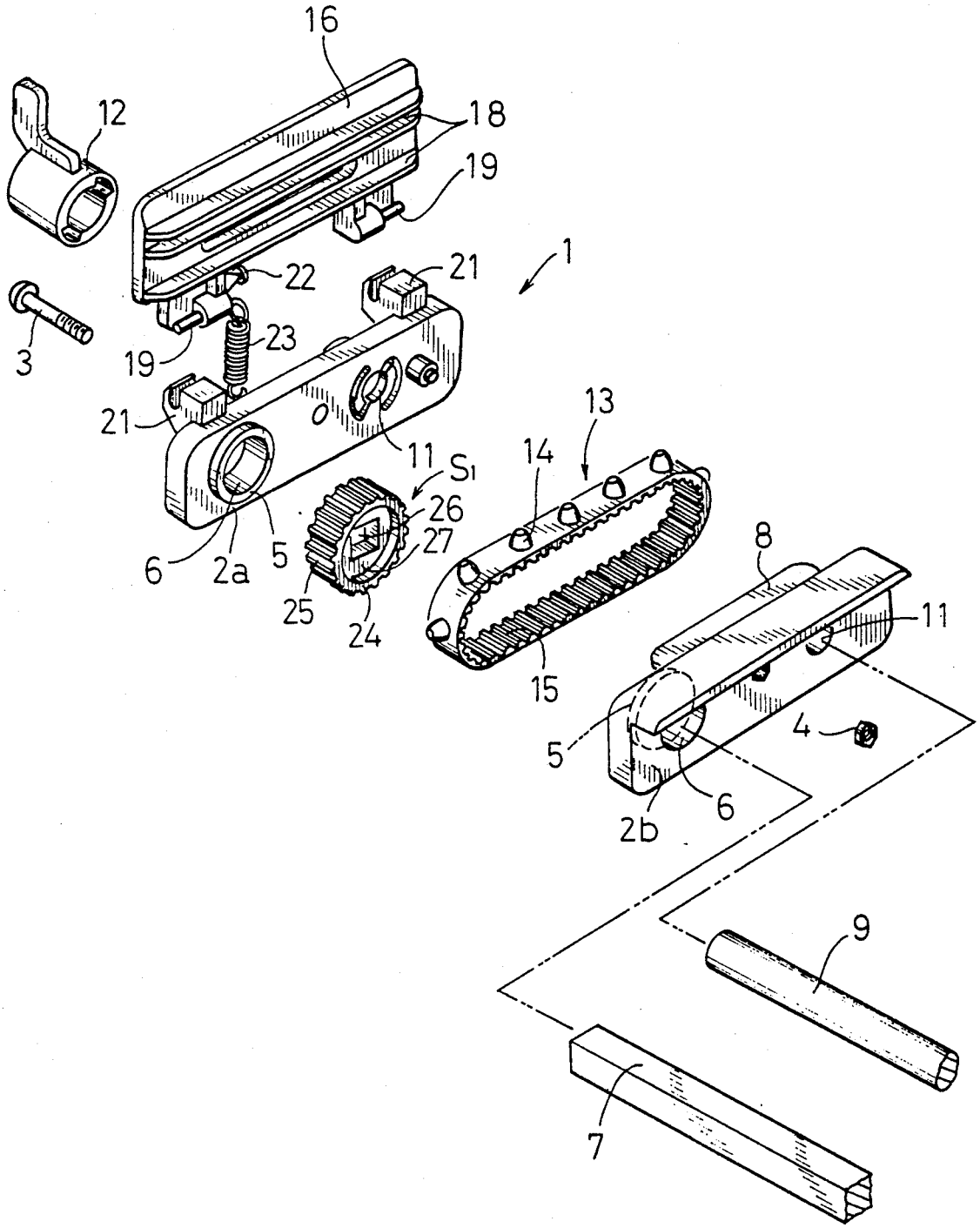
FIG. 1 is an exploded perspective view of a paper feed apparatus with a driving sprocket $S_1$ mounted thereon in accordance with the present invention.
Figure 2:
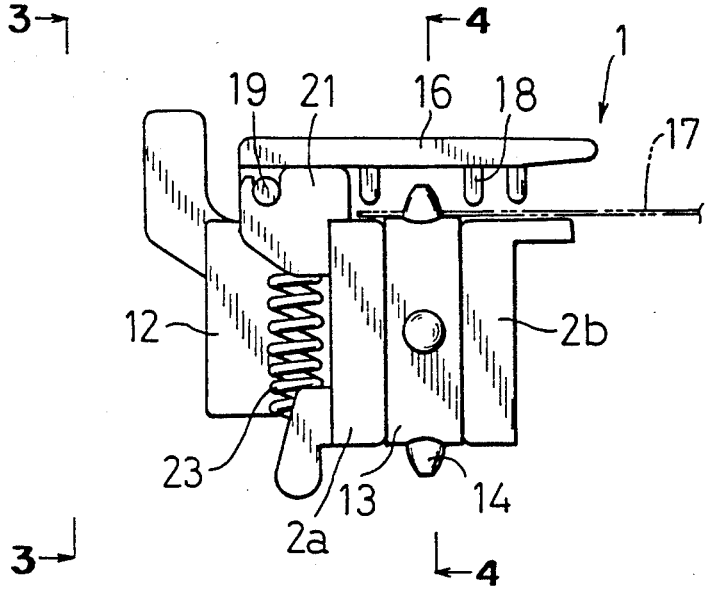
FIG. 2 is a side view of the paper feed apparatus 1 with the driving sprocket $S_1$ mounted thereon in accordance with the present invention.
Figure 3:
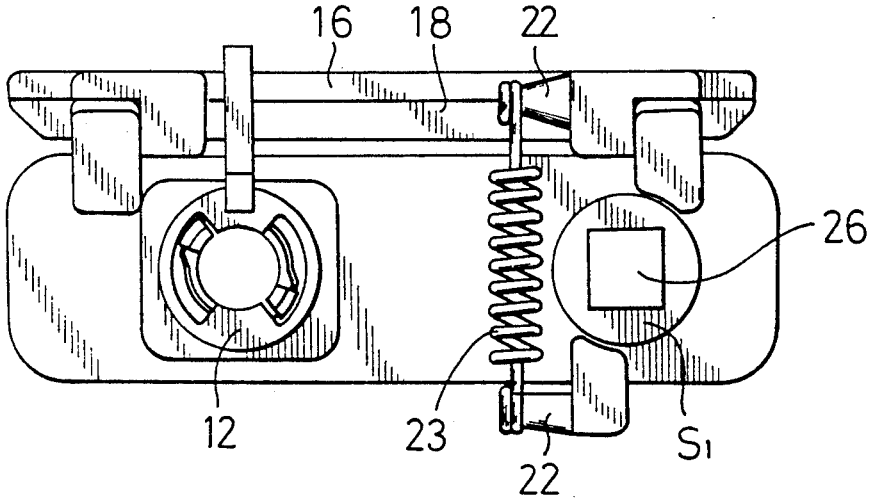
FIG. 3 is a view taken along line 3—3 of FIG. 2.

First of all, the outline of the paper feed apparatus 1 which uses, as a receiving member for a feed belt, a belt receiver disposed integrally with side frames will be explained briefly with reference to FIGS. 1–4 and then the portion of the driving sprocket $S_1$ of the present invention will be explained in detail.

A pair of side frames 2*a* and 2*b* are connected to each other by a connecting bolt 3 and a nut 4 in the state where they oppose each other with a predetermined gap between them. A round fitting protuberance 5 projects from the inner surface of each side frame 2*a*, 2*b* and moreover, at one of its end portions in the longitudinal direction so as to correspond to a receiving recess 27 of a later-described driving sprocket $S_1$. A through hole 6 which is concentric with the fitting protuberance 5 is bored at that portion of each side frame 2*a*, 2*b* at which the fitting protuberance 5 is disposed. This through hole 6 permits the insertion of a driving shaft 7.

Figure 4:
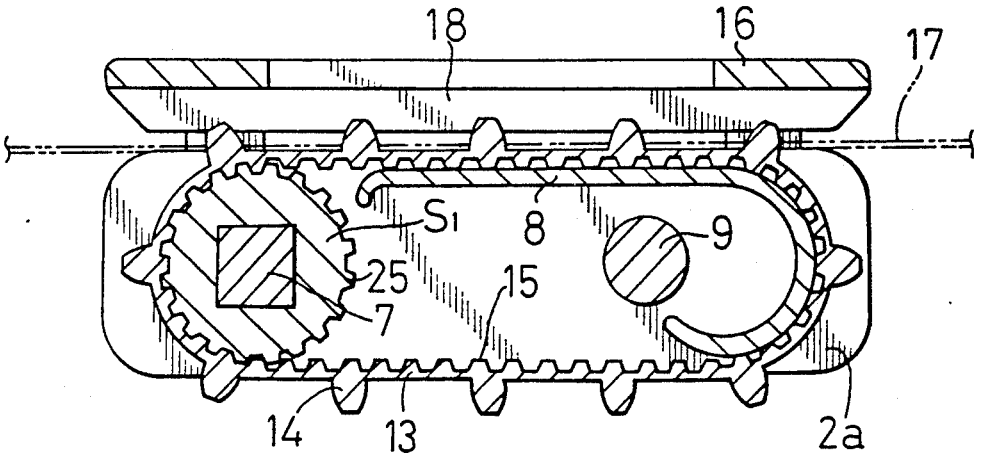
FIG. 4 is a sectional view taken along line 4—4 in FIG. 2 in the state where a driving shaft 7 and a support shaft 9 are inserted.
Figure 5:
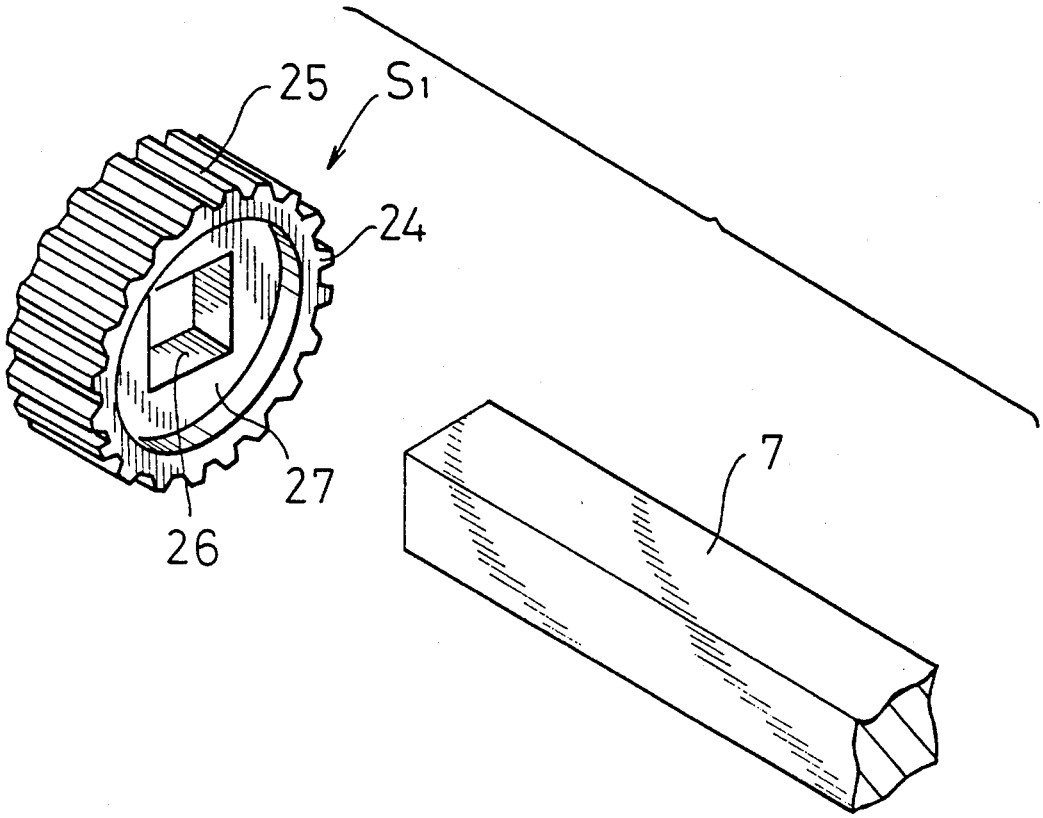
FIG. 5 is an enlarged perspective view of a driving sprocket $S_1$ and driving shaft 7.
Figure 6:
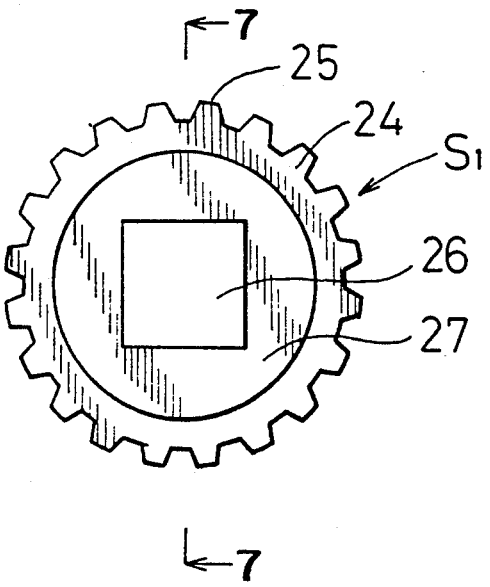
FIG. 6 is a front view of the driving sprocket $S_1$.
Figure 7:
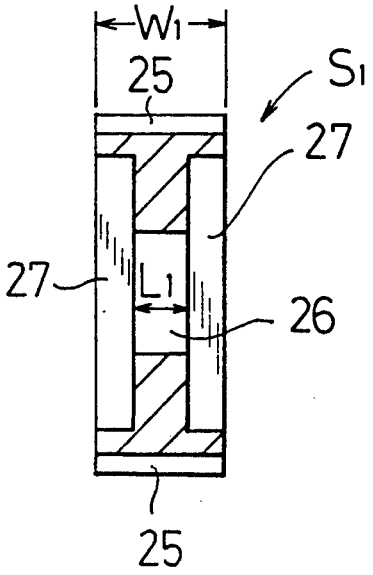
FIG. 7 is a sectional view taken along line 7—7 in FIG. 6.

A belt receiver 8 serving as a receiving member for a later-described feed belt 13 is disposed integrally on the inner surface of one of the side frames, here the frame 2*b*, and one of the ends of this belt receiver 8 (the end portion opposite to the end portion where the fitting protuberance 5 is disposed) is shaped in an arc (see FIG. 4).

Another through hole 11 for the insertion of a support shaft 9 is formed at the other end portion of each side frame 2*a*, 2*b* opposite the through hole 6. The support shaft 9 which is inserted into the through hole 11 of each side frame 2*a*, 2*b* is fixed to the side frame 2*a* by a clamp member 12 so that the paper feed apparatus 1 is fixed as a whole to the support shaft 9.

A large number of feed pins 14 protrude from the outer peripheral surface of an endless feed belt 13 at a predetermined pitch, and inner gear teeth 15 are formed on its inner peripheral surface.

A plurality of guide ribs 18 are formed on the back of a cover 16 in a paper feeding direction in order to prevent floating of a sheet of paper 17 during its feed operation. A pair of support shafts 19 are disposed on this cover 16 and cover receiving portions 21 corresponding to the pair of support shafts 19 are formed on one of the side frames, here the side frame 2a. The cover 16 is fitted to the side frame 2a in such a manner as to be capable of opening and closing by fitting each support shaft 19 disposed on the cover 16 into a corresponding cover receiving portion 21 disposed on the side frame 2a and hooking both ends of a tensile spring 23 to a spring arm 22 which is disposed on each of the cover 16 and the side frame 2a.

Next, the driving sprocket $S_1$ having the structure relating to the invention will be explained with reference to FIGS. 5–8.

The driving sprocket $S_1$ is molded from a flexible material such as a synthetic resin. In the same way as ordinary sprockets, gear teeth 25 are formed around the rim or outer peripheral surface of a sprocket main body 24, and a square hole-like shaft hole 26 is bored at its center. Round recesses 27 which are concentric with the shaft hole 26 are formed on both side surfaces of the inner peripheral portion of the sprocket main body 24 around the shaft hole leaving the outer peripheral portion where the gear teeth 25 are disposed with the full thickness.

Accordingly, the thickness of the inner peripheral portion of the sprocket main body 24 is smaller than that of the outer peripheral portion and the length ($L_1$) of the shaft hole 26 is smaller than the width ($W_o$) of the feed belt 13 already described. Incidentally, the width ($W_1$) of the portion of the gear teeth 25 of the driving sprocket $S_1$ is substantially equal to the width ($W_o$) of the feed belt 13.

Figure 8:
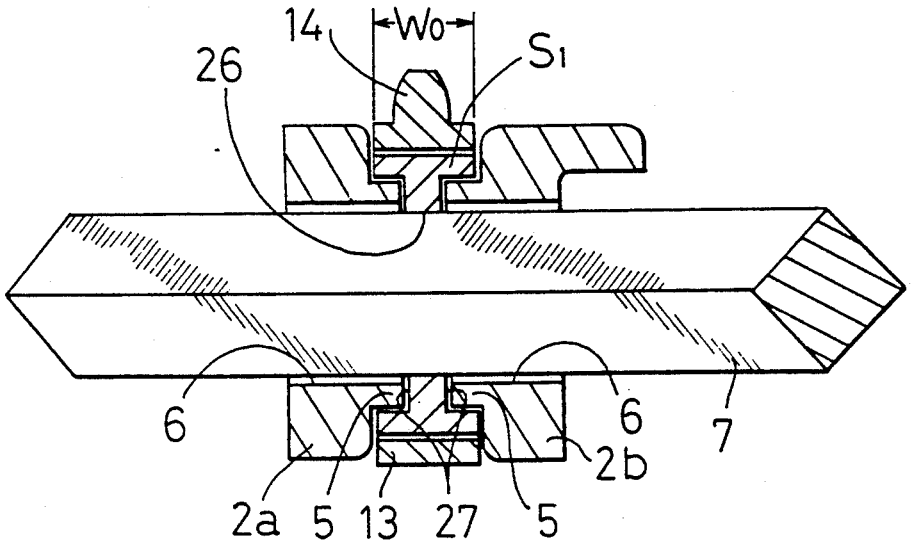
FIG. 8 is a sectional view in an axial direction in the state where the driving shaft 7 is inserted into a shaft hole 26 of the driving sprocket $S_1$.

When the pair of fitting protuberances 5 on the inner surfaces of the pair of side frames 2a, 2b are fitted in the recesses 27 disposed on both side surfaces of the sprocket main body 24 as shown in FIG. 8, the driving sprocket $S_1$ is interposed between the pair of side frames 2a, 2b and is supported rotatably by them. The endless feed belt 13 is passed around the driving sprocket $S_1$ supported in this manner between the pair of side frames 2a, 2b and the belt receiver 8 disposed on the inner surface of one 2b of the side frames. The inner gear teeth 15 of the feed belt 13 mesh with the gear teeth 25 of the driving sprocket $S_1$.

When the driving shaft 7 is fitted into the shaft hole 26 of the sprocket main body 24 and is then rotated, the feed belt 13 travels due to the rotation of the driving sprocket $S_1$.

As described above, since the length ($L_1$) of the shaft hole 26 of the driving sprocket $S_1$ is smaller than the width ($W_o$) of the feed belt 13 and moreover, since the thickness of the outer peripheral portion of the shaft hole 26 is constant, the dimension in the axial direction of the shaft hole 26 becomes uniform when the driving sprocket $S_1$ is molded from a resin, its dimensional accuracy can be improved and the clearance between the shaft hole 26 and the driving shaft 7 fitted into it can be minimized. Accordingly, the phase difference between the driving sprocket $S_1$ during the paper feed operation and the driving shaft 7 becomes smaller and paper feed accuracy can be improved. Since the length ($L_1$) of the shaft hole 26 formed in the driving sprocket $S_1$ is small, sliding resistance between the inner peripheral surface of the shaft hole 26 of the driving sprocket $S_1$ and the outer peripheral surface of the driving shaft 7 becomes smaller when the driving shaft 7 is fitted into this shaft hole 26 and the paper feed apparatus 1 is moved along the driving shaft 7. Therefore, even when the clearance between the shaft hole 26 of the driving sprocket $S_1$ and the driving shaft 7 fitted into it is made smaller, the paper feed apparatus 1 can be moved along the driving shaft 7 by relatively small force.

Figure 9:
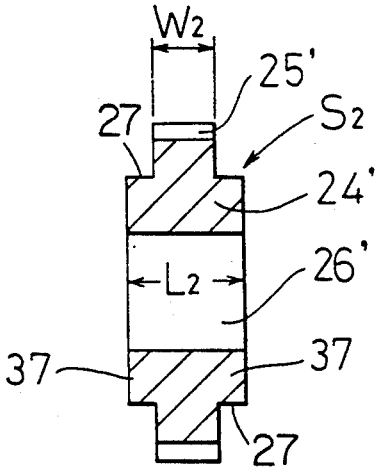
FIG. 9 is a sectional view of a driving sprocket $S_2$.
Figure 10:
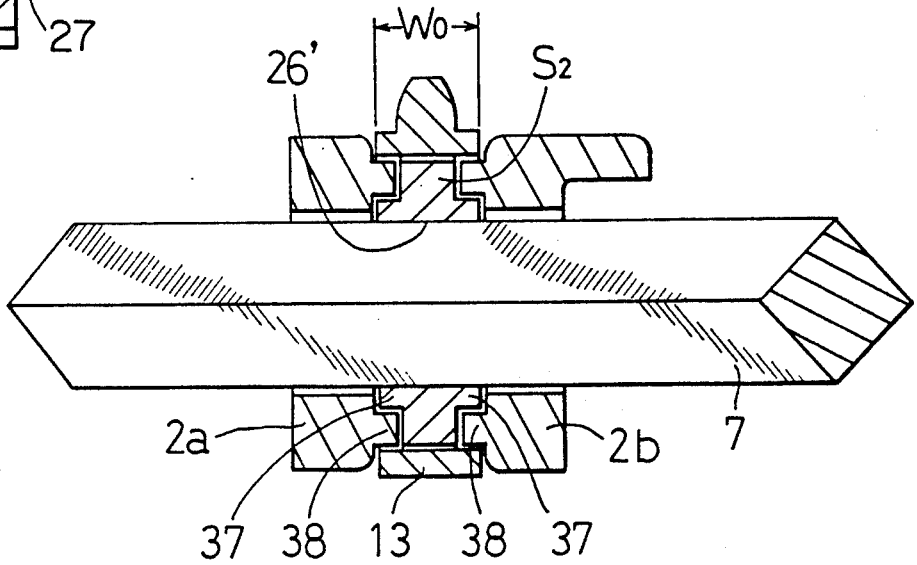
FIG. 10 is a sectional view of the axial direction in the state where the driving shaft 7 is inserted into a shaft hole 26' of the driving sprocket $S_2$.

FIGS. 9 and 10 show another driving sprocket $S_2$ of the invention.

In this driving sprocket $S_2$, the recesses 27 are at the rim, so that the length ($L_1$) of the shaft hole 26' formed in the sprocket main body 24' is substantially equal to the width ($W_o$) of the feed belt 13 and the width ($W_2$) of the gear teeth 25' is smaller than the length ($L_2$) of the shaft hole 26'. Furthermore, the hub portions 37 are disposed on both side surfaces of the sprocket main body 24'. Fitting protuberances 38 are formed integrally on the inner surfaces of the pair of side frames 2a, 2b and the hub portions 37 of the sprocket main body 24' are fitted to the inner portions of the protuberances 38 so that the pair of protuberances 38 disposed on the side frames 2a, 2b rotatably support the driving sprocket $S_2$.

Figure 11:
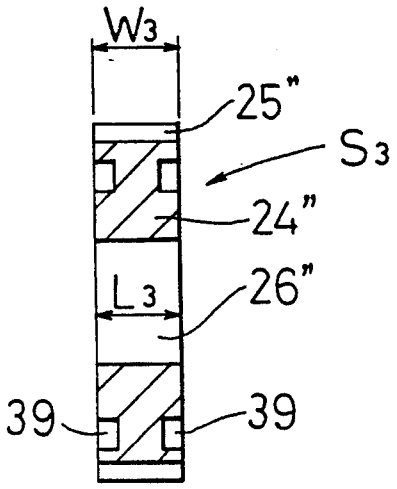
FIG. 11 is a sectional view of a driving sprocket $S_3$.
Figure 12:
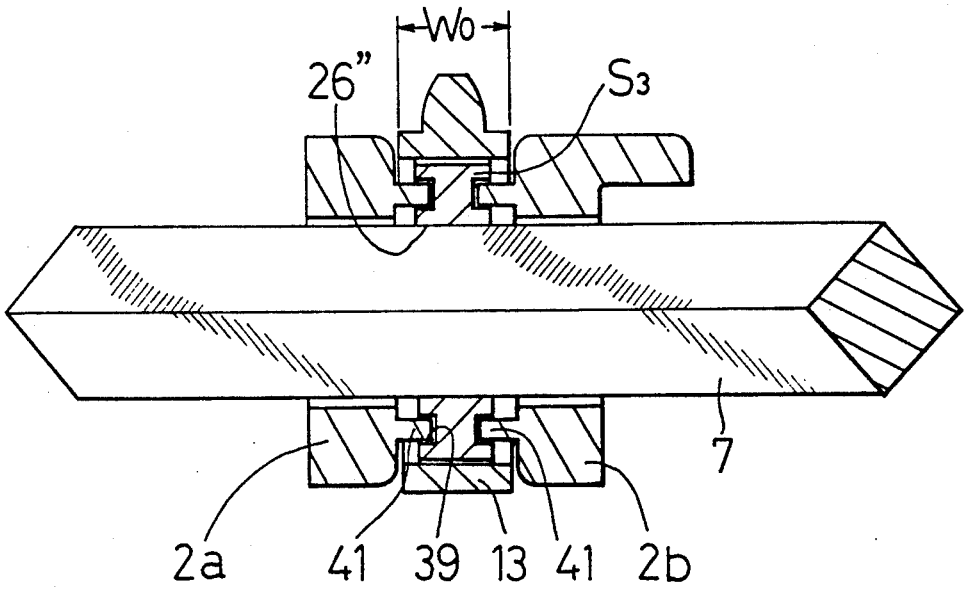
FIG. 12 is a sectional view in the axial direction in the state where the driving shaft 7 is inserted into a shaft hole 26'' of the driving sprocket $S_3$.
Figure 13:
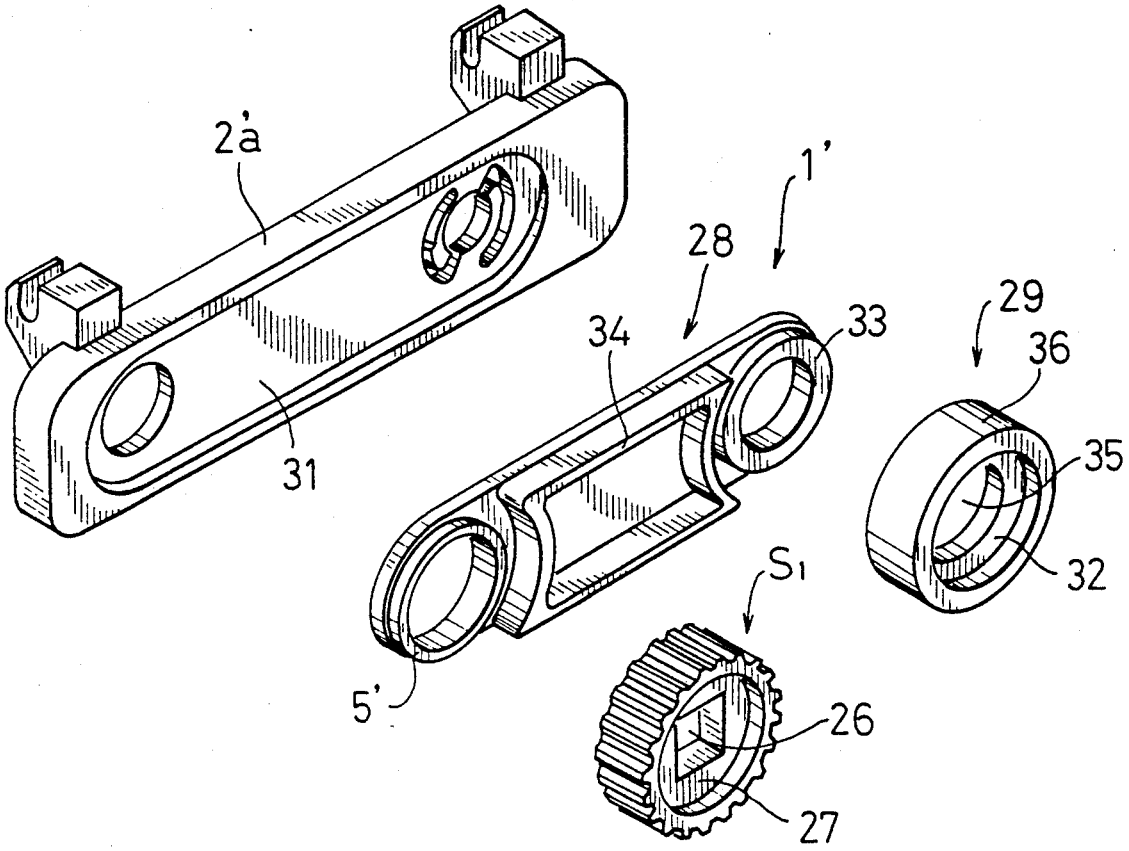
FIG. 13 is a perspective view of a side frame 2'a, an auxiliary frame 28, the driving sprocket $S_1$ and a belt reception rotary member 29 that constitute the paper feed apparatus 1'.
Figure 14:
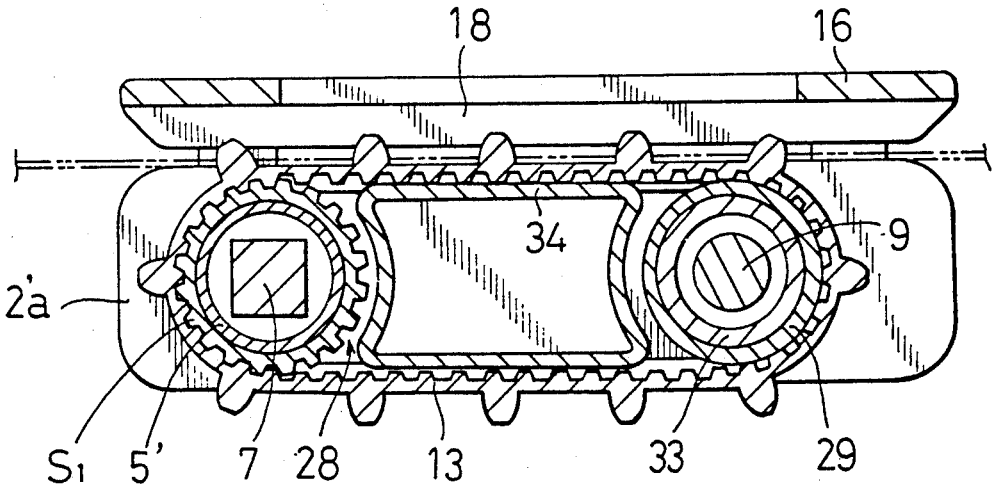
FIG. 14 is a sectional view in a direction orthogonal to the driving shaft 7 of the paper feed apparatus 1' equipped with the auxiliary frame 28.
Figure 15:
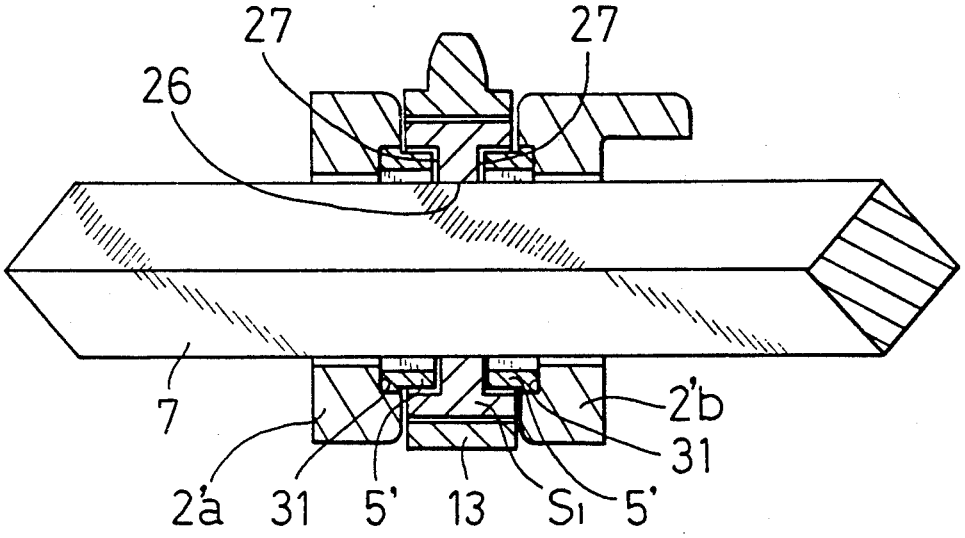
FIGS. 15 and 16 are sectional views in the axial direction of the driving shaft 7 and support shaft 9 of the paper apparatus 1', respectively.
Figure 16:
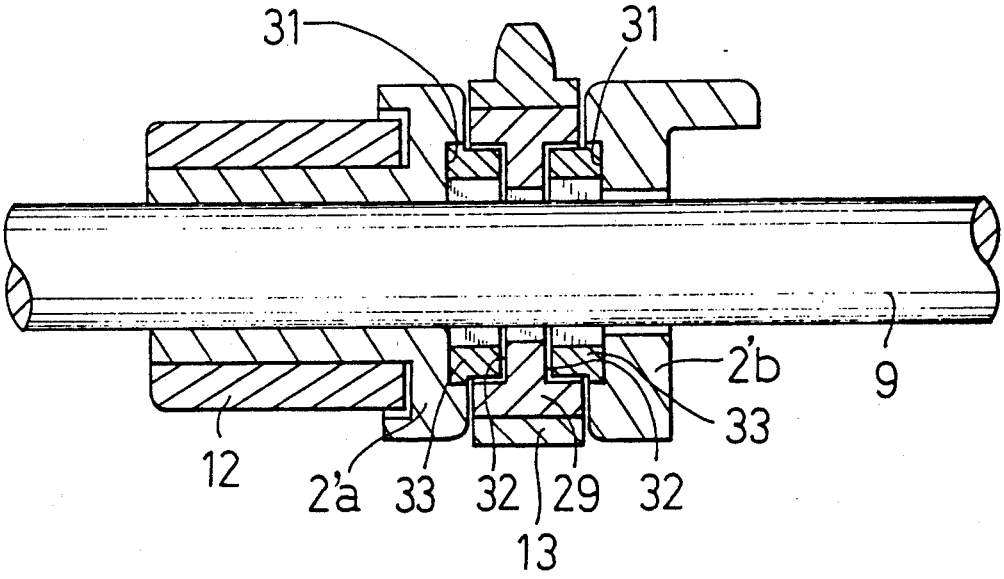
Figure 17:
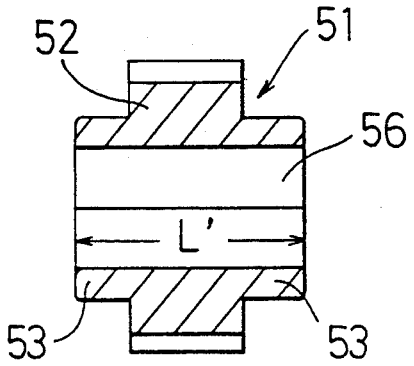
FIG. 17 (PRIOR ART)
FIG. 17 is a sectional view in a direction of a shaft hole 56 of a conventional driving sprocket 51.
Figure 18:
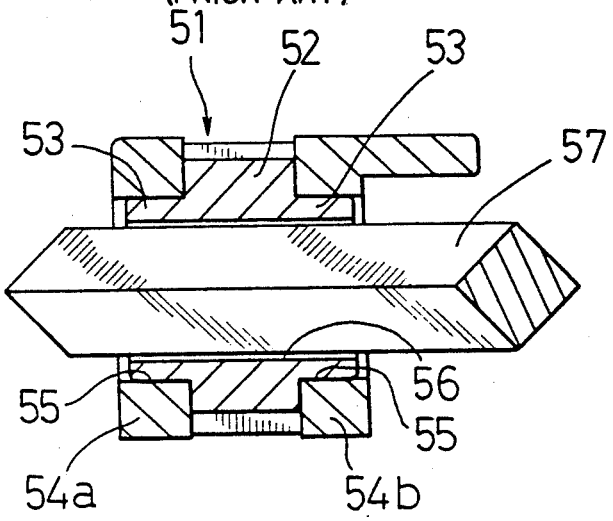
FIG. 18 (PRIOR ART)
FIG. 18 is a sectional view in the direction of the driving shaft 57 in the state where the driving shaft 57 is inserted into the driving sprocket 51 disposed between a pair of side frames 54*a* and 54*b* and supported by them.
Figure 19:
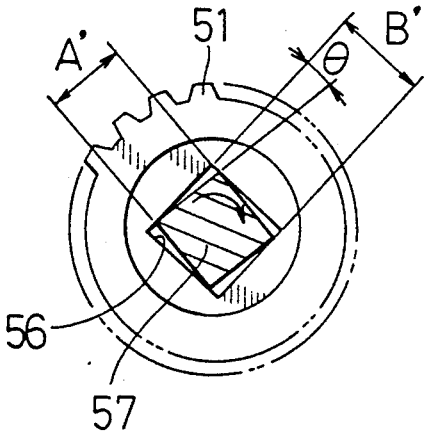
FIG. 19 (PRIOR ART)
FIGS. 19 and 20 are drawings useful for explaining the phenomenon where the phases of the driving sprocket 51 and the driving shaft 57 deviate from each other in the rotation direction, respectively.
Figure 20:
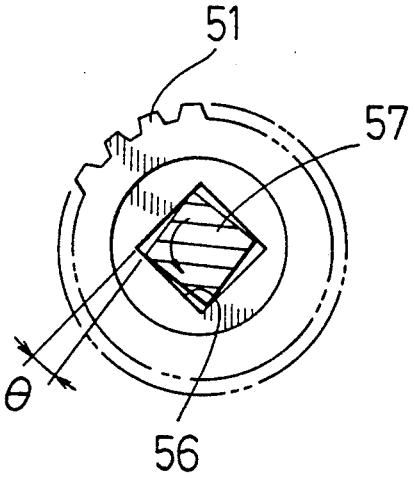
FIG. 20 (PRIOR ART)

FIGS. 11 and 12 show still another driving sprocket $S_3$ of the present invention.

The sprocket main body 24'' of the driving sprocket $S_3$ has a ring-like shape, the length $L_3$ of the shaft hole 26'' and the width $W_3$ of the portion of the gear teeth 25'' are equal to each other and they are smaller than the width $W_o$ of the feed belt 13. Further, ring-like recesses 39 are disposed on both side surfaces of the sprocket main body 24''. Fitting protuberances 41 are disposed integrally on the inner surfaces of the pair of side frames 2a, 2b and are fitted into the ring-like recesses 39 which are disposed on both side surfaces of the sprocket main body 24'', so that the driving sprocket $S_3$ is supported rotatably by the pair of protuberances 41 disposed on the side frames 2a, 2b.

The length $L_2$ of the shaft hole 26' of the driving sprocket $S_2$ is substantially equal to the width $W_o$ of the feed belt 13 and the length $L_3$ of the shaft hole 26'' of the driving sprocket $S_3$ is smaller than the width $W_o$ of the feed belt 13. Accordingly, molding can be made by making the dimension uniform in the axial direction of the shaft holes 26', 26'', and the clearance between the shaft holes 26', 26'' and the driving shaft 7 fitted into them can be minimized. The paper feed apparatus shown in FIGS. 13–16 is an example of the apparatus which is equipped with an auxiliary frame 28 and moreover, wherein the receiving members for the feed belt 13 disposed at the other end portions of the pair of side frames 2'a, 2'b are composed of the belt reception rotary member 29.

Receiving holes 31 for fitting the auxiliary frame 28 are formed on the inner side surfaces of the pair of side frames 2'a, 2'b, respectively, and the auxiliary frame 28 is fitted into these receiving holes 31 in such a manner as to be movable finely in the linear travelling direction of the feed belt 13.

A fitting protuberance 5' corresponding to the fitting recess 27 disposed in the driving sprocket $S_1$ is provided on one of the ends of this auxiliary frame 28 and a fitting protuberance 33 corresponding to the fitting recess 32 disposed in the belt reception rotary member 29 is provided on its other end. The belt receiver 34 is disposed between these fitting protuberances 5' and 33 and is integral with the auxiliary frame 28. The belt rotary member 29 has a structure wherein round receiving recesses 32 are formed on both side surfaces of a short cylindrical rotary member main body 36 which is equipped at its center with a through hole 35 for the insertion of the support shaft 9.

the auxiliary frames 28 are fitted into the receiving holes 31 disposed on the inner side surfaces of the pair of side frames 2'a, 2'b, respectively, and the fitting protuberances 5', 33 provided in the auxiliary frames 28 are fitted in the receiving recesses 27, 32 formed in the driving sprocket $S_1$ and belt reception rotary member 29, respectively. When the feed belt 13 is passed around the driving sprocket $S_1$ and the belt reception rotary member 29 and the side frames 2'a, 2'b are connected together, the driving sprocket $S_1$ and the belt reception rotary member 29 can be rotatably supported by the fitting protuberances 5', 33 provided on the pair of auxiliary frames 28. This paper feed apparatus 1' has high paper feed accuracy because the distance between the centers of the driving sprocket $S_1$ and belt reception rotary member 29 does not change.

In some cases, a driven sprocket having the same structure as the driving sprocket $S_1$ is used in place of the belt reception rotary member as the receiving member for the feed belt 13 and the feed belt 13 is passed around this driven sprocket and the driving sprocket $S_1$.

What is claimed is:

1. In a paper feed apparatus which includes a pair of side frames opposed to each other with a predetermined gap between them, an endless feed belt disposed between said pair of side frames and a driving sprocket disposed between said pair of side frames and annular protuberances at one of the end portions of said pair of side frames rotatably supporting said driving sprocket, said feed belt being passed around said driving sprocket, and a receiving member disposed at the other end portions of said pair of side frames, and said feed belt being run around said driving sprocket and receiving member by the rotation of said driving sprocket to feed a sheet of paper, an improved driving sprocket having a main body having a shaft hole therethrough and having a rim around the outer periphery with gear teeth thereon, said sprocket main body having a thickness in the axial direction of said shaft hole no greater than the width of said feed belt and having opposite side faces, said socket main body further having a recess in each of said side faces and extending around said shaft hole into which said protuberances extend for rotatably supporting said driving sprocket.

2. An improved driving sprocket as claimed in claim 1 in which said recesses are around the shaft hole.

3. An improved driving sprocket as claimed in claim 1 in which said recesses are at the rim.

4. An improved driving sprocket as claimed in claim 1 in which said recesses are intermediate the rim and the shaft hole.

5. In a paper feed apparatus, the combination of a pair of side frames opposed to each other with a predetermined gap between them, an endless feed belt disposed between said pair of side frames and movable in a path having two parallel portions, a driving sprocket disposed between said pair of side frames and supported rotatably at one of the end portions of said pair of said frames, a belt reception rotary member disposed between said pair of side frames and supported rotatably at the other end portions of said pair of side frames, said feed belt being run around said driving sprocket and said belt reception rotary member by the rotation of said driving sprocket to feed a sheet of paper, the inner opposed side surfaces of said pair of side frames having recesses thereon, and auxiliary frames fitted in said recesses so as to be movable slightly in the direction of travel of said parallel portions of said feed belt and having fitting protuberances thereon projecting inwardly, said belt reception rotary member having round fitting recesses in both end surfaces of the inner peripheral portion thereof so as to leave the thickness in the direction of the axis of rotation thereof of the inner peripheral portion of said belt reception rotary member smaller than the thickness of the remainder thereof, said fitting protuberances being fitted into said fitting recesses so as to support rotatably said belt reception rotary member between said pair of frames.

* * * * *